United States Patent [19]

Unger

[11] Patent Number: 4,718,730

[45] Date of Patent: Jan. 12, 1988

[54] CROSS-AXIS CUTTING ASSEMBLY OF A SELECTIVE CUTTING MACHINE

[75] Inventor: Eberhart Unger, Lünen, Fed. Rep. of Germany

[73] Assignee: Gewerkschaft Eisenhutte Westfalia GmbH, Postfach, Fed. Rep. of Germany

[21] Appl. No.: 917,009

[22] Filed: Oct. 9, 1986

[30] Foreign Application Priority Data

Oct. 10, 1985 [DE] Fed. Rep. of Germany ..... 3536171

[51] Int. Cl.[4] ..... E21C 7/08

[52] U.S. Cl. ..... 299/75; 299/81

[58] Field of Search ..... 299/75, 81, 12, 17

[56] References Cited

U.S. PATENT DOCUMENTS 3,799,615 3/1974 Taylor et al. ..... 299/81 X
4,289,357 9/1981 Hintermann et al. ..... 299/81
4,470,636 9/1984 Paurat et al. ..... 299/81

FOREIGN PATENT DOCUMENTS 197805 5/1978 Fed. Rep. of Germany ..... 299/81
2019920 11/1979 United Kingdom ..... 299/81

*Primary Examiner*—George A. Suchfield
*Attorney, Agent, or Firm*—Thompson, Birch, Gauthier & Samuels

[57] ABSTRACT

A cross-axis cutting assembly of a selective cutting machine is provided with internally-fed spray means. The assembly includes two cutting heads supported by a boom, the cutting heads being driven by a shaft which is transverse to the boom. A high pressure water supply line for each cutting head is provided by means of a connecting member. Each connecting member is arranged externally on the boom, is preferably designed as a channelled plate, and closely fits the external contour of the associated cutting head. Each connecting member extends to the free end of the shaft, and is connected to an internal high pressure water duct formed in the associated cutting head by means of a rotary arrangement. Each rotary arrangement has an axial pin which fits sealingly into a passage.

9 Claims, 3 Drawing Figures

CROSS-AXIS CUTTING ASSEMBLY OF A SELECTIVE CUTTING MACHINE

BACKGROUND TO THE INVENTION

This invention relates to a cross-axis cutting assembly of a selective cutting machine.

Such an assembly typically has two cutting heads supported by a boom, the cutting heads being driven by a shaft directed transversely to the boom. Spray nozzles are arranged on the cutting heads, the nozzles being connected, via pressure water ducts formed in the cutting heads and via rotary arrangements, to an external high pressure water supply line (Journal "Glückauf" 1985, page 1206).

Selective cutting machines are used to advance tunnels, galleries and the like, including galleries driven through rock and seams in underground mines, and for the winning of mineral deposits. To abate the dust formed during cutting operations, to cool the cutting tools, and to avoid methane ignition in fire-damp mines, it is necessary to spray the working region with water under pressure. Generally, internal spraying is adopted, that is to say water under pressure is supplied from the exterior, and is introduced into each of the cutting heads via a rotary arrangement. The pressurised water is then fed to spray nozzles arranged on the periphery of the cutting heads via pressure water ducts formed in the cutting heads. A cutting head having such internally-fed spray nozzles is generally equipped with means for controlling the supply of pressurised water which ensures that water is fed only to the spray nozzles located in the region of the cutting head whose cutters are actually cutting (see DE-OS No. 28 10 982 and EP-PS No. 10 534).

With selective cutting machines used in hazardous mines, it is becoming more and more necessary to spray water intentionally into the working region of the individual cutters, that is to say in the cutting tracks thereof, in such a way that effective abatement of dust and particularly effective cooling of the cutting zones is achieved, whilst ignition of issuing methane gas by spark formation in the cutting zone is also avoided. With this process, working pressures of the order of at least 100 to 200 bar, and frequently even 300 bar and higher are required for the spray water. Considerable sealing problems arise with such high working pressures if the rotary arrangement is arranged on the roller hub or the drive shaft of a cutting head. The sealing problems are greater, the greater the diameter of the shaft or hub of the cutting head provided with the rotary arrangement. When using a planetary gear positioned within a cutting head, the shaft diameter to be sealed by the rotary arrangement is not excessively large so that, at least if the working pressures of the spray water are not too high, the sealing problems can generally be solved. The conditions may be different if a mitre gear is provided instead of the planetary gear. The use of a mitre gear has the substantial advantage over a planetary gear that a cutting head can have reduced diameter. On the other hand, however, considerable problems arise in providing the resultant large diameter drive shaft of a cutting head with a rotary arrangement for the supply of pressurised water which acts as a reliable seal for a prolonged operating time under the necessarily high pressures of the spray water.

The object of the invention is, therefore, to provide a cross-axis cutting assembly whose cutting heads have internally-fed spray nozzles, which assembly avoids using rotary arrangements of large diameter, whilst ensuring reliable introduction of the high pressure water into the cutting heads and through the cutting heads to the spray nozzles.

SUMMARY OF THE INVENTION

The present invention provides a cross-axis cutting assembly of a selective cutting machine having two cutting heads supported at the end of a boom, the cutting heads being driven by a shaft orientated transversely to the boom, the cutting heads being formed with internal water ducts for feeding pressurised water to spray nozzles, the water ducts being connected via respective rotary arrangements to an outer high pressure water supply line, wherein the water ducts of each cutting head are fed with pressurised water from the high pressure water supply line by a respective connecting member arranged externally on the boom, each connecting member being connected, on the side of the associated cutting head remote from the boom, to the adjacent end of the shaft via the respective rotary arrangement, each rotary arrangement having an axial pin fitting sealingly in an axial passage.

Accordingly, pressurised water is supplied to each cutting head of the assembly via a respective connecting member arranged on the boom from the outer end face of that cutting head, the drive shaft ending at the side of each cutter head remote from the boom, and being joined to the associated connecting member via the respective rotary arrangement. Accordingly, rotary arrangements of small diameter, which do not give rise to problems of sealing and wear even at high spray water pressures of 200 to 300 bar or higher, can be provided on the shaft of large diameter. A control and distribution system which, as known, is designed in such a way that a cutting track spray is produced on the cutters in engagement with the respective working face can be arranged inside each of the cutting heads. The connecting members may be designed and arranged in such a way that they do not obstruct the working movements of the assembly during the cutting operation. Preferably, each connecting member is adapted to the external contour of the associated cutting head, and designed in such a way that it fits the roller contour. Thus, each connecting member extends from its end fixed to the boom to the free end of the shaft at which the associated rotary arrangement is located.

In a preferred embodiment, each connecting member is a channelled plate which is robust and is not susceptible to wear. Advantageously, each channelled plate is shaped to conform to the external contour of the associated cutting head, and diminishes in width towards the end thereof which is connected to the shaft.

Preferably, each cutting head has, at its end remote from the other cutting head, a tapered end portion which in which the shaft ends and into which the associated connecting member fits. The connecting members, therefore, lie, in the region of their ends forming the rotary arrangements, inside the peripheral contour of the cutting heads in the tapered ends thereof.

Advantageously, the axial pin of each rotary arrangement is provided on the associated connecting member, and the axial passage of that rotary arrangement is formed in the free end of the shaft. Preferably, the axial passage is a blind bore. Conveniently, the water duct formed in each cutting head terminates at the periphery of the blind bore between seals, and is connected in this region to a transverse duct formed in the axial pin.

BRIEF DESCRIPTION OF THE DRAWINGS

The invention is described in more detail below with reference to the embodiment illustrated in the drawings, in which.

DESCRIPTION OF PREFERRED EMBODIMENT

Figure 1:
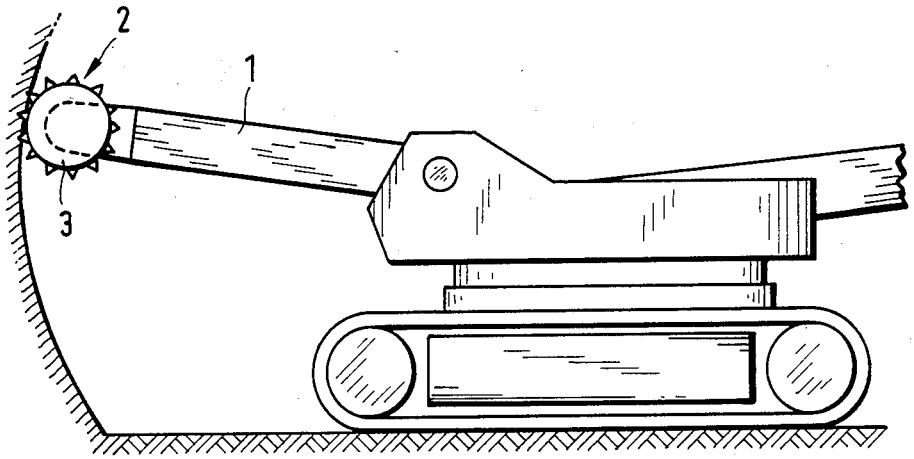
FIG. 1 is a schematic side view of a selective cutting machine incorporating a cross-axis cutting assembly provided with internally-fed spray means.
Figure 2:
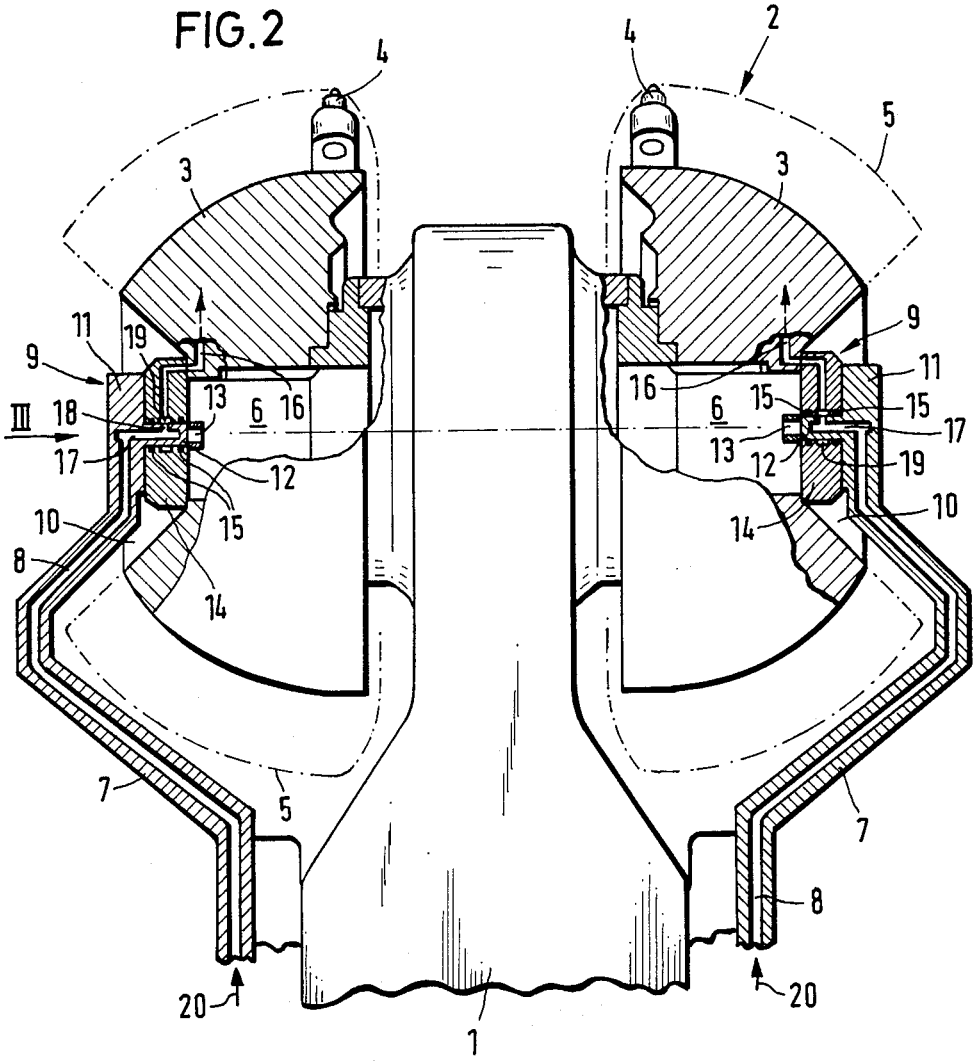
FIG. 2 is a plan view, partially in horizontal section, of the cross-axis cutting assembly.
Figure 3:
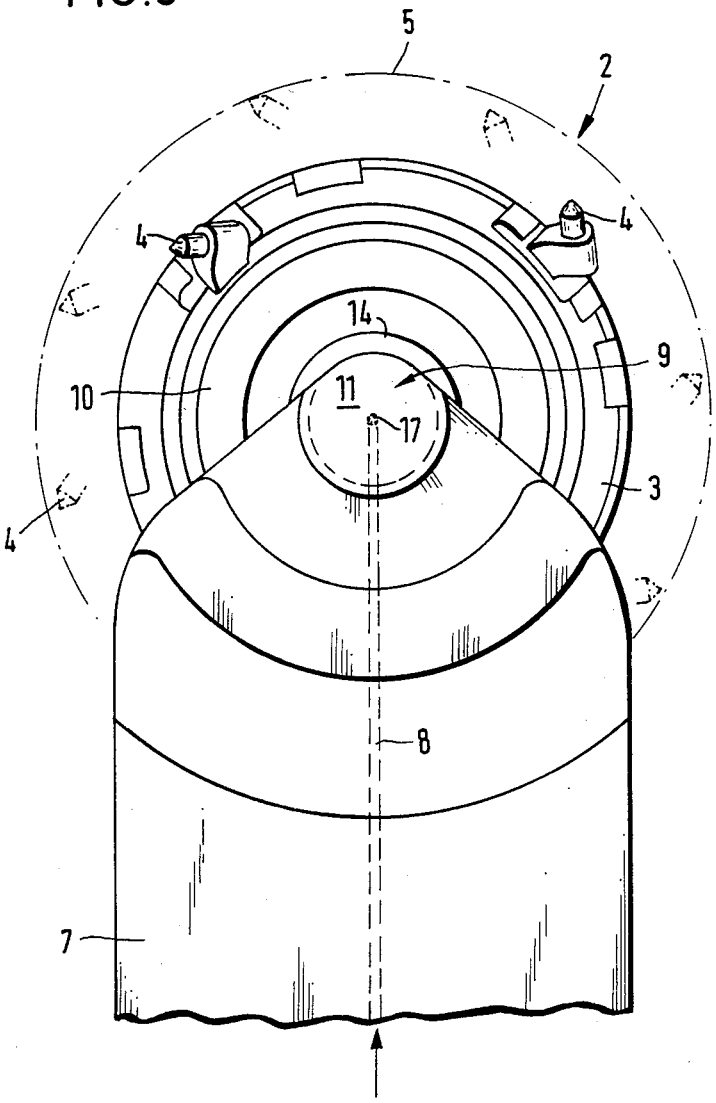
FIG. 3 is a side view, looking in the direction of the arrow II in FIG. 2, of the assembly of FIG. 2.

Referring to the drawings, FIG. 1 shows a known type of road header (selective cutting machine) which is used as an advance or winning machine. The machine frame is supported by caterpillar tracks, and is provided with a laterally and vertically pivotal boom 1 bearing on its free end a cross-axis cutting assembly 2 which has two cutting heads 3 which are arranged symmetrically in a mirror image. The cutting heads 3 are rotatable about a common axis running perpendicularly to the axis of the boom 2, and each is equipped on its periphery with cutting tools 4. FIGS. 2 and 3 show only a few cutting tools 4, each of which is a round shaft cutter held exchangeably in a cutter holder. The circumference of the cutter tips of the cutting heads 3 is indicated by the dot-dash lines 5 in FIGS. 2 and 3. The common drive of the two cutting heads 3 is not shown, being located together with gearing in the interior of the boom 1 which is of box girder construction. The two cutting heads 3 are arranged in rotationally engaged manner on a drive shaft 6 orientated transversely to the boom 1. The drive shaft 6 may be a common continuous drive shaft. Alternatively, respective drive shafts 6 can be provided for each of the cutting heads 3.

Each of the cutting heads 3 is provided with an internally-fed spray means which directs pressurised water on to respective sector cut by that head at the face. The spray nozzles, which are distributed over the periphery of the cutting heads 3, are not shown in the drawings. The nozzles are arranged on the periphery of each cutting head 3, in known manner, in such a way that they spray pressurised water out into the cutting regions of the individual cutters 4.

Cross-axis cutting assemblies of this type are well known, as is the design of their cutting heads and internally-fed spray means. The supply of water under high pressure to the two cutting heads 3, which are provided, in known manner, with pressure water ducts leading to the individual spray nozzles is essential to the invention.

For the pressure water supply, each cutting head 3 has a connecting member 7 which is fixed externally on the boom 1, and is provided with a continous pressure water duct 8. Each connecting member 7 is connected on that side of the respective cutting head 3 remote from the boom 1 to the adjacent end of the shaft 6 via a rotary arrangement 9. Each connecting member 7 comprises a channelled plate which, as shown best in FIG. 3, tapers acutely towards its front end overlapping the shaft 6. Each channelled plate 7 is, as shown in FIG. 2, angled transversely to its plane several times so that it fits closely against the external contour defined by the circumference 5 of the associated cutting head 3. Each cutting head 3 has, at its end remote from the other cutting head, a respective tapered end portion 10, within which the shaft 6 ends, and into which the connecting end 11 of the associated channelled plate 7 fits.

Each channelled plate 7 has, at its connecting end 11, an axial cylindrical pin 12 which points in the direction of the shaft axis, and fits into a blind axial passage 13 at the end of the shaft 6 to form the rotary arrangement 9. In the embodiment illustrated, a respective stop plate 14 is fixed at each end of the shaft 6, each stop plate having the associated passage 13 and the connecting end 11 of the associated channelled plate 7 lying against it. Each connecting end 11 is preferably detachably connected to the adjacent shaft end or to the associated stop plate 14, for example by a screw fitting.

Each pin 12 is sealed in the associated passage 13 by means of sealing rings 15. Each channelled plate 7 has, in the region of its end connected to the boom 1, a high pressure water connection (not shown) through which water is supplied at a pressure which is generally at least 100 to 200 bar, and preferably of the order of 300 bar and higher. This high pressure connection is connected, via the associated high pressure water duct 8, to the rotary arrangement 9; and, via the rotary arrangement 9, to the high pressure water duct 16 formed in the associated cutting head 3. Each high pressure water duct 8 extends from the high pressure water connection through the associated channelled plate 7 to the connecting end 11 thereof. It then passes through an axial duct 17 in the associated pin 12 which is connected, via at least one transverse duct 18, to an annular groove 19 in the associated stop plate 14. The high pressure water duct 16 of that cutting head 3 opens into the associated annular groove 19. The high pressure water supplied thus flows, in the direction of the arrows 20, through the high pressure water ducts 8 and the axial passages 17 to the rotary arrangements 9. It then flows, via the transverse ducts 18 and the annular groove 19, into the high pressure water ducts 16 of the cutting heads 3. Inside each cutting head 3, the high pressure water supply to the individual spray nozzles is controlled in such a way that only the cutters 4 which are actually cutting are sprayed during the cutting operation. Such control means are known, for example, from DE-OS No. 28 10 982.

It can be seen that each of the rotary arrangements 9, whose diameter is considerably smaller than the diameter of the shaft 6, is produced by means of the associated pin 12 fitting into the adjacent axial passage 13 in the shaft 6. Rotary arrangements 9 with such small diameters do not give rise to particular sealing problems, even at high pressures of from 200 to 300 bar or even higher. The cutting operation of the cross-axis cutting assembly 2 is not impaired by the externally-arranged connecting members 7. Connecting members of a different design, for example sections of a tube or the like, can be used instead of the channelled plates 7. It might also be possible to arrange the pins 12 of the rotary arrangements 9 at the ends of the shaft 6 or on the stop plates 14 fixed to the shaft ends, in which case they would fit sealingly into axial passages a the connecting ends 11.

I claim:

1. A cross-axis cutting assembly of a selective cutting machine having two cutting heads supported at the end of a boom, the cutting heads each being mounted on and driven by an adjacent end of a shaft oriented transversely to the boom, the cutting heads being formed with internal water ducts for feeding pressurised water to spray nozzles, the water ducts being connected via respective rotary arrangements to an external high pressure water supply line, wherein the water ducts of each cutting head are fed with pressurised water from the high pressure water supply line by a respective connecting member arranged externally on the boom, each connecting member being adapted to the external contour of the associated cutting head and being connected to the adjacent end of the shaft via the respective rotary arrangement, each rotary arrangement having an axial pin on the respective connecting member fitting sealingly in an axial passage in the adjacent shaft end.

2. An assembly according to claim 1 wherein each connecting member is a plate having a channel-shaped cross section.

3. An assembly according to claim 2, wherein each plate has a width measured in a direction transverse to the axis of the shaft which diminishes towards the end thereof connected to the shaft.

4. An assembly according to claim 1, wherein each cutting head has, at its end remote from the other cutting head, a tapered end portion in which the shaft ends and into which the associated connecting member fits.

5. An assembly according to claim 1, wherein the axial pin of each rotary arrangement is provided on the associatd connecting member, and the axial passage of rotary arrangement is formed in the free end of the shaft.

6. An assembly according to claim 5, wherein the axial passage is a blind bore.

7. An assembly according to claim 6, wherein the water duct formed in each cutting head terminates at the periphery of the blind bore between seals, and is connected in this region to a transverse duct formed in the axial pin.

8. An assembly according to claim 1, wherein a respective stop plate is fixed at each free end of the shaft, each stop plate containing part of the associated rotary arrangement.

9. A cross-axis cutting assembly of a selective cutting machine having two cutting heads supported at the end of a boom, the cutting heads each being mounted on and driven by an adjacent end of a shaft orientated transversely to the boom, the cutting heads being formed with internal water ducts for feeding pressurised water to spray nozzles, the water ducts being connected via respective rotary arrangements to an external high pressure water supply line, wherein the water ducts of each cutting head are fed with pressurised water from the high pressure water supply line by a respective connecting member arranged externally on the boom, each connecting member being a plate having a channel-shaped cross section and being adapted to the external contour of the associated cutting head with a width dimension measured in a direction transverse to the shaft axis which diminishes towards the end thereof connected to the shaft, each connecting member being connected to the adjacent end of the shaft via the respective rotary arrangement, each rotary arrangement having an axial pin on the respective connecting member fitting sealingly in an axial passage in the adjacent shaft end.

* * * * *